US007118400B1

(12) United States Patent
Lopez et al.

(10) Patent No.: US 7,118,400 B1
(45) Date of Patent: Oct. 10, 2006

(54) VEHICLE POWER SYSTEM WITH ROTATABLE MAIN ASSEMBLY

(75) Inventors: Alberto A. Lopez, St. Petersburg, FL (US); John Catalano, Palm Harbor, FL (US); Nathan Wincek, New Port Richey, FL (US)

(73) Assignee: AAMP of Florida, Inc., Clearwater, FL (US)

( * ) Notice: Subject to any disclaimer, the term of this patent is extended or adjusted under 35 U.S.C. 154(b) by 0 days.

(21) Appl. No.: 11/318,221

(22) Filed: Dec. 23, 2005

(51) Int. Cl.
*H01R 29/00* (2006.01)

(52) U.S. Cl. ..... 439/170; 439/715; 439/620.29

(58) Field of Classification Search ..... 439/621, 439/622, 224, 217, 218, 712, 715, 717, 718, 439/166, 170, 171, 174, 620.28, 620.27, 439/620.29, 620.34
See application file for complete search history.

(56) References Cited

U.S. PATENT DOCUMENTS

| | | | | |
|---|---|---|---|---|
| 5,504,655 | A | | 4/1996 | Underwood et al. |
| 6,004,159 | A | * | 12/1999 | Liang ..... 439/621 |
| 6,608,399 | B1 | | 8/2003 | McConnell et al. |
| 2004/0080211 | A1 | | 4/2004 | Pavlacka et al. |

* cited by examiner

*Primary Examiner*—Ross Gushi
(74) *Attorney, Agent, or Firm*—Larson & Larson, PA; Frank W. Liebenow

(57) ABSTRACT

A power system includes power inputs, power outputs and power protection and/or power conditioning adapted between the power inputs and power outputs. In some embodiments, a graphics display is included in the system for displaying graphic images from an external video source. The power system is configurable such that the power inputs appear on the left side and outputs on the right side or the opposite with power inputs on the right side and outputs on the left.

20 Claims, 9 Drawing Sheets

VEHICLE POWER SYSTEM WITH ROTATABLE MAIN ASSEMBLY

BACKGROUND OF THE INVENTION

This application is related to U.S. application Ser. No. 11/317,535 titled, "VEHICLE POWER SYSTEM WITH INTEGRATED GRAPHICS DISPLAY," which was filed on even date herewith; and inventors Alberto A. Lopez, John Catalano and Nathan Wincek. Additionally, this application is related to U.S. application Ser. No. 11/317,539 titled, "VEHICLE POWER SYSTEM WITH WIRE SIZE ADAPTER," which was filed on even date herewith; and inventors Alberto A. Lopez, John Catalano and Nathan Wincek. Additionally, this application is related to U.S. application Ser. No. 11/317,699 titled, "VEHICLE POWER SYSTEM UTILIZING OVAL WIRE," which was filed on even date herewith; and inventors Alberto A. Lopez, John Catalano and Nathan Wincek.

1. Field of the Invention

The present invention relates to the field of conditioning or distributing power and more particularly to an apparatus that provides a power conditioning, distribution and/or fusing in one integrated device that is configurable to allow input wires to enter on either side and output wires to exit on the opposite side.

2. Description of the Related Art

Automotive accessories are becoming more functional and decorative. High power audio amplifiers, lighting systems, automation systems and even waterfalls have been installed in vehicle doors, passenger compartments and trunks. These devices utilize large amounts of power and put significant loads on the vehicle's power distribution systems. The art has many examples of vehicle power distribution, including U.S. Pat. No. 6,746,279, "Power Distribution System," to Lopez, which is hereby incorporated by reference. This patent describes a power distribution and fusing system that accepts one or two larger power wires, fuses the power and distributes the power over several smaller gauge wires.

Additionally, there is a need for lighting and display. U.S. Pat. No. 6,181,563, "Meter Device for Vehicle," to Shimbu, et al, describes a vehicle metering and display device and is hereby incorporated by reference. This device has a display for displaying vehicle speed and engine speed, for example. The display is mounted in the passenger compartment and visible to the driver. The device of this patent does not distribute power to other devices. Furthermore, the display is provided for displaying information according to signals from the electronic component units integrated into the device and not enabled to accept external, fully-graphical video sources.

Historically, power has been distributed by a single power cable carrying one voltage potential, usually positive, and the frame of the vehicle carrying the other voltage potential, usually negative. The power cables of the prior art are generally heavy gauge, stranded wire of a size suitable for carrying the current required by the load. Standard wire comes in sizes that are numbered based upon its diameter and hence current carrying capacity with the higher numbers used for smaller wire having lower current carrying capacity. For heavy loads, a larger wire size is used. Unfortunately, as more current is required, the wire diameter increases requiring higher-profile connecting devices, causing difficulty in bending and shaping the wire and, when run under carpet, creating bumps and bulges. Oval shape wire has been used in very narrow applications for delivering high-voltage power in the AC power grid. For example, U.S. Pat. No. 5,171,942 to Wilber F. Powers, issued Dec. 12, 1992, describes a specialized oval wire for overhead high tension lines and is hereby incorporated by reference. This patent describes a very special type of oval power line and does not imply any other use for such oval cable. In another example, U.S. Pat. No. 6,353,177 B1 to Walter W. Young, issued Mar. 5, 2002 describes a cable of oval form, but the core conductor is round and the insulator is oval. This type of power cable has all the issues related to a round cable described above with no advantage for automotive use. The oval design of its insulation improves its wind resistance which is not an issue in automotive applications.

Unfortunately, there is a lack of power conditioning, fusing, and/or distribution devices that have power inputs/outputs that can be swapped to allow the inputs to be on one side or the other.

What is needed is an apparatus that will provide a power circuit that permits configuration of power input on a first side or on the opposite side and optionally provide a graphics display.

SUMMARY OF THE INVENTION

An object of the present invention is to provide a power distribution device that allows configurations with power inputs on a first side or on the opposite side with power outputs on the remaining side. In some embodiments, a graphics display is provided for displaying a wide range of colors, patterns and video.

In one embodiment, power distribution system with configurable input-output connections is disclosed including an enclosure and a configurable power distribution device removably housed within the enclosure. The configurable power distribution device is adapted to accept power from at least one power input connector and is adapted to deliver the power to at least one power output connector. The at least one power input connector is situated on a first side surface of the configurable power distribution device and the at least one power output connector is situated on a second side surface of the configurable power distribution device. The second side surface of the configurable power distribution device directly opposes the first side surface of the configurable power distribution device and the configurable power distribution device is configurable such that the first side surface of the configurable power distribution device is aligned with a side surface of the enclosure.

In another embodiment, a method for distributing power is disclosed including providing a power system with an enclosure and a configurable power distribution device removably housed within the enclosure. The configurable power distribution device adapted to accept power from at least one power input connector and is adapted to deliver the power to at least one power output connector. The at least one power input connector situated on a first side surface of the configurable power distribution device and the at least one power output connector is situated on a second side surface of the configurable power distribution device, the second side surface of the configurable power distribution device directly opposes the first side surface of the configurable power distribution device. The configurable power distribution device is configurable such that the first side surface of the configurable power distribution device is aligned with a side surface of the enclosure. Next, the power distribution device is installed into the enclosure such that the at least one power input connector is positioned towards at least one power input wire and the at least one power output connector is positioned towards at least one power output wire. Next, the at least one power output wire is connected to the at least one power output connector and a set screw associated with each of the at least one power output connectors is tightened. Finally, the at least one power input wire is connected to the at least one power input connector and another set screw associated with each of the at least one power input connectors is tightened.

In another embodiment, a power distribution system is disclosed including an enclosure, a graphics display mounted within a display enclosure which is hingedly coupled to the enclosure and a power distribution device housed within the enclosure for accepting power from a power input and for distributing power to a power output. The power input is situated on a side edge of the power distribution device and the power output is situated on an opposite side edge. The enclosure is adapted to permit the installation of the power distribution device in a first configuration having the power inputs on a left side of the enclosure and to permit the installation in a second configuration having the power input on the right side of the enclosure.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
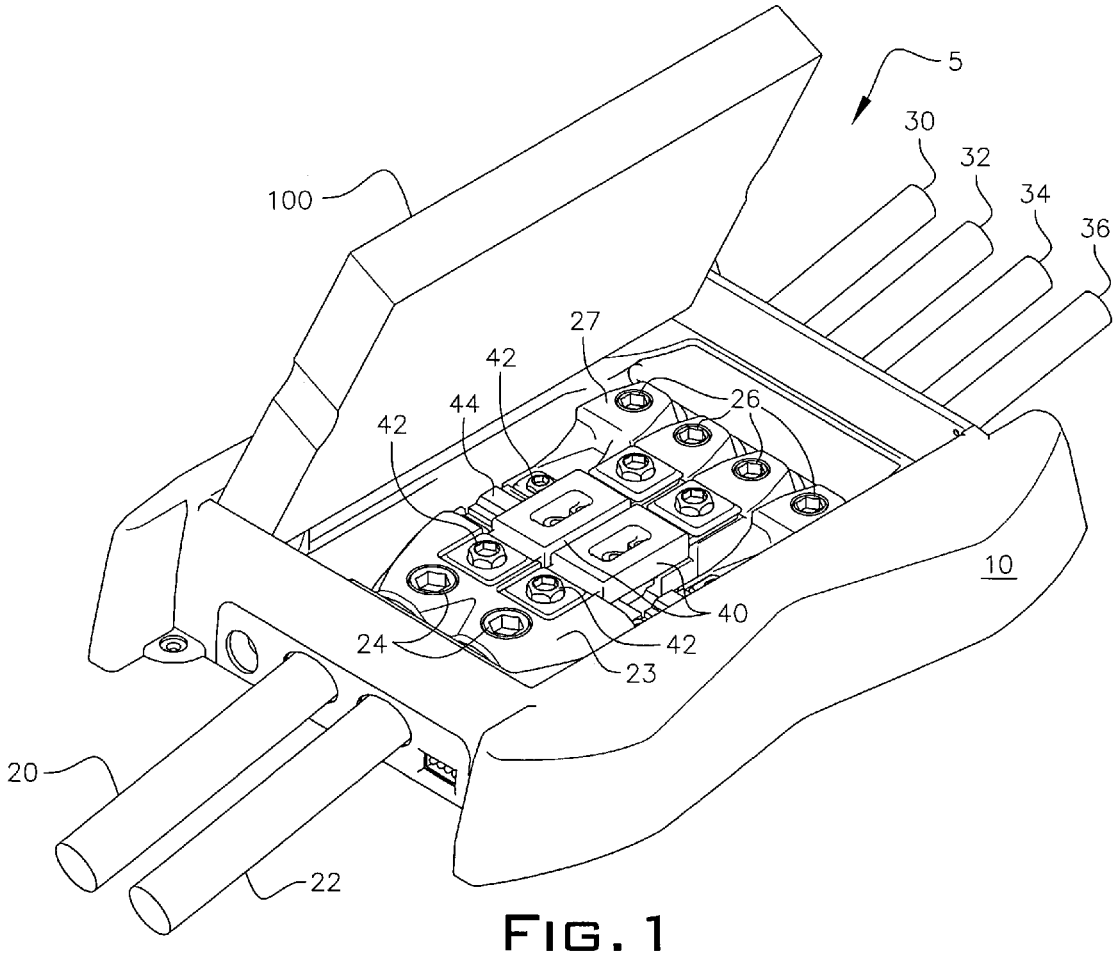
FIG. 1 illustrates a perspective view of the apparatus of the present invention.

Reference will now be made in detail to the presently preferred embodiments of the invention, examples of which are illustrated in the accompanying drawings. Throughout the following detailed description, the same reference numerals refer to the same elements in all figures. In the description of the device for distributing power of the present invention, the perspective views include a display and a power option having two power inputs, a plurality of fuses and four power outputs. This is an example of one possible configuration, whereas any number of inputs and outputs as well as several different power options are described later and can be installed into the same housing. The graphics display is multipurpose, in that it is useful for displaying video such as a video stream from a DVD player and text as well as emitting a wide range of colors and patterns, providing both aesthetic as well as safety features.

Referring to FIG. 1, a perspective view of the apparatus of the present invention is shown. The power distribution system 5 includes an outer case 10 with a display (not visible) housed within a display housing 100. The power distribution system 5 has a rotatable and exchangeable power distribution device allowing configuration with various power options that can be oriented so that power enters on the left side and exits on the right side or visa-versa, providing flexibility in the viewing direction of the display. The power distribution system 5 in this embodiment has two power inputs 20/22 connected through a power input connector, in this embodiment, a terminal block 23 and physically/electrically held by set screws 24. The terminal block is sized to accept a specific size of wire. In some embodiments, the wire is oval or elliptical so that it lies flat when routed through a vehicle, especially under carpet, bends easy and so that the power distribution system can be designed to have a lower profile than if round wire is used. The inputs 20/22 are connected to a first terminal 42 of the fuses 40/44. In this embodiment, two types of fuses are installed 40/44 but in some embodiments, only one type of fuse is installed providing flexibility in protection for each output 30/32/34/36 in that a first type of fuse has current ranges up to 40 amps, while another type fuse has current ranges up to 750 amps. The second terminal 42 of the fuses 40/44 is connected to a power output connector, in this embodiment, a second terminal block 27 for connection to the output power cables 30/32/34/36, held electrically/physically with set screws 26.

Figure 2:
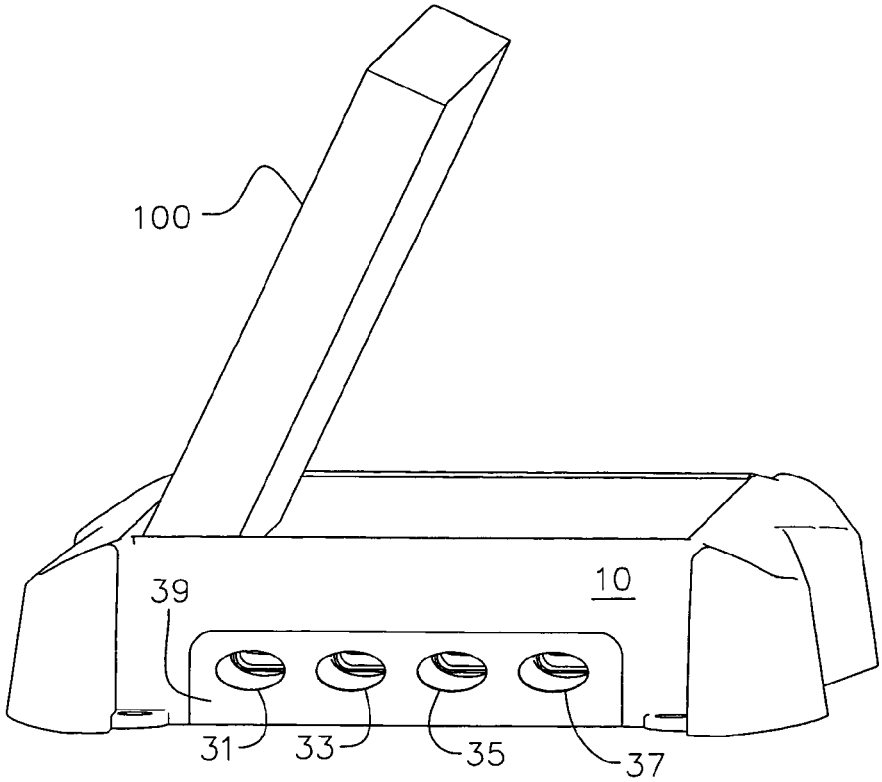
FIG. 2 illustrates a right-side perspective view of the present invention.

Referring to FIG. 2, a right-side perspective view of the present invention is shown. The case 10 has a side cut-out that is filled with a surface 39 of the power distribution module and has four openings 31/33/35/37 configured to accept four output power cables (30/32/34/36 from FIG. 1). The display housing 100 is shown slightly tilted. In this embodiment, the display is rotatably coupled to the outer case 10 allowing adjustment to its angles.

Figure 3:
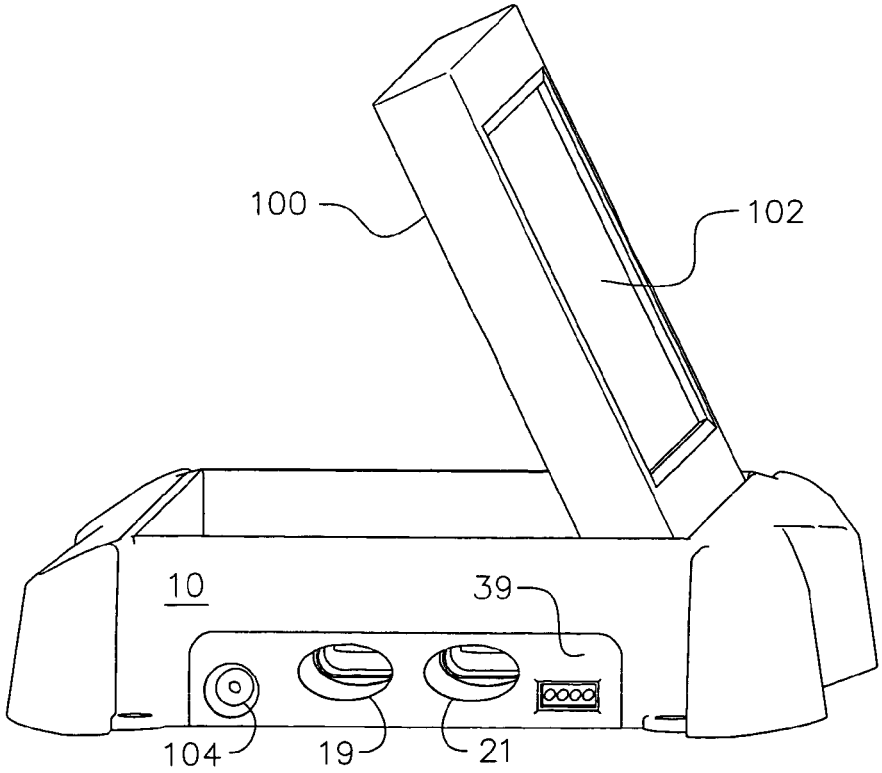
FIG. 3 illustrates a left-side perspective view of the present invention.

Referring to FIG. 3, a left-side perspective view of the present invention is shown. The outer case 10 has a side cut-out that is filled with a surface 39 of the power distribution module and has two openings 19/21 configured to accept two input power cables (20/22 from FIG. 1). The display housing 100 is shown slightly tilted and the display 102 is visible. The display 102 is of any flat panel display technology known in the industry, including but not limited to plasma, liquid crystal display (LCD), etc. In this embodiment, a video input connector 104 is provided for providing a video source to the display 102. In some embodiments, display content is generated internally, providing varying colors, patterns and lighting effects.

Figure 4:
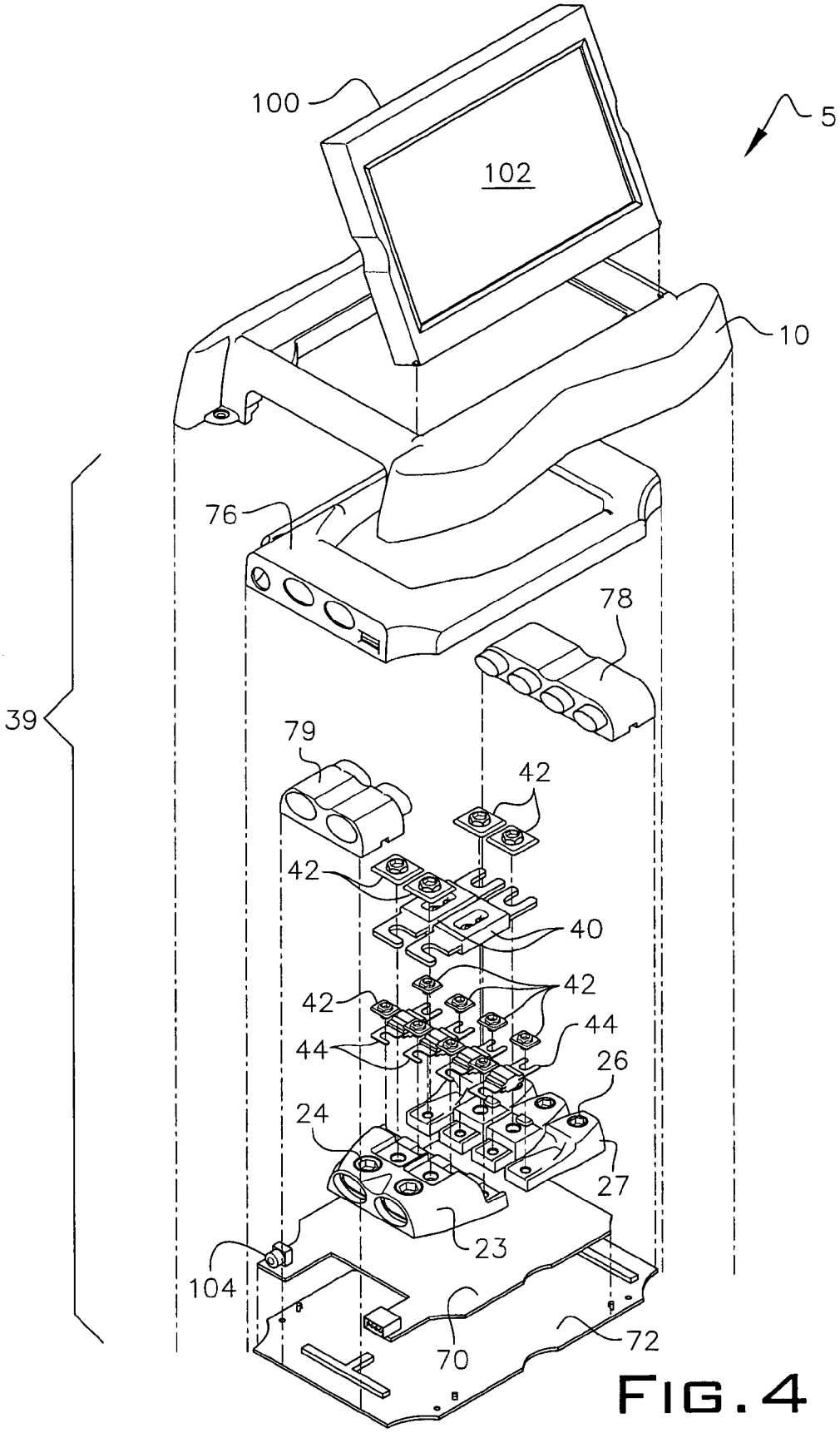
FIG. 4 illustrates an exploded view of the present invention.

Referring to FIG. 4, an exploded view of the present invention is shown. The power distribution system 5 includes an outer case 10 with a display 102 housed within a display housing 100 that is hingedly connected to the outer case 10. The power distribution system 5 has rotatable and exchangeable power distribution devices configurable with various power options that can be oriented so that power enters on the left side and exits on the right side or visa-versa, providing flexibility in the viewing direction of the display. The power distribution system 5 in this embodiment has two power input connectors which are, in this embodiment, a terminal block 23. The input power wires are physically and electrically held by set screws 24. The inputs are connected to a first terminal 42 of the fuses 40/44. In this embodiment, two types of fuses are installed 40/44, In some embodiments, only one type of fuse 40 or the other 44 is installed providing flexibility in protection for each output. The second terminal 42 of the fuses 40/44 is connected to a second power output connector, in this embodiment, a terminal block 27 for connection to the output power wires (30/32/34/36 in FIG. 1), held electrically and physically with set screws 26. The power distribution module 39 has a modular housing 76 that is symmetrical so that the power distribution module 39 is adaptable to be mounted within the outer case 10 in one orientation or in another opposite orientation, rotated 180 degrees horizontally. Wire guides 79 guide the two power input wires (20/22) into the terminal block 23 and wire guides 78 guide the power output wires (30/32/34/36) into the output terminal block 27. A circuit board 70 provides power and video distribution to the display 102 and holds the video input connector 104. In some embodiments, a graphics display controller (see FIG. 6) is mounted on the circuit board 70. A bottom cover 72 protects the circuit board and holds the power distribution module 39 within the outer case 10.

Figure 5:
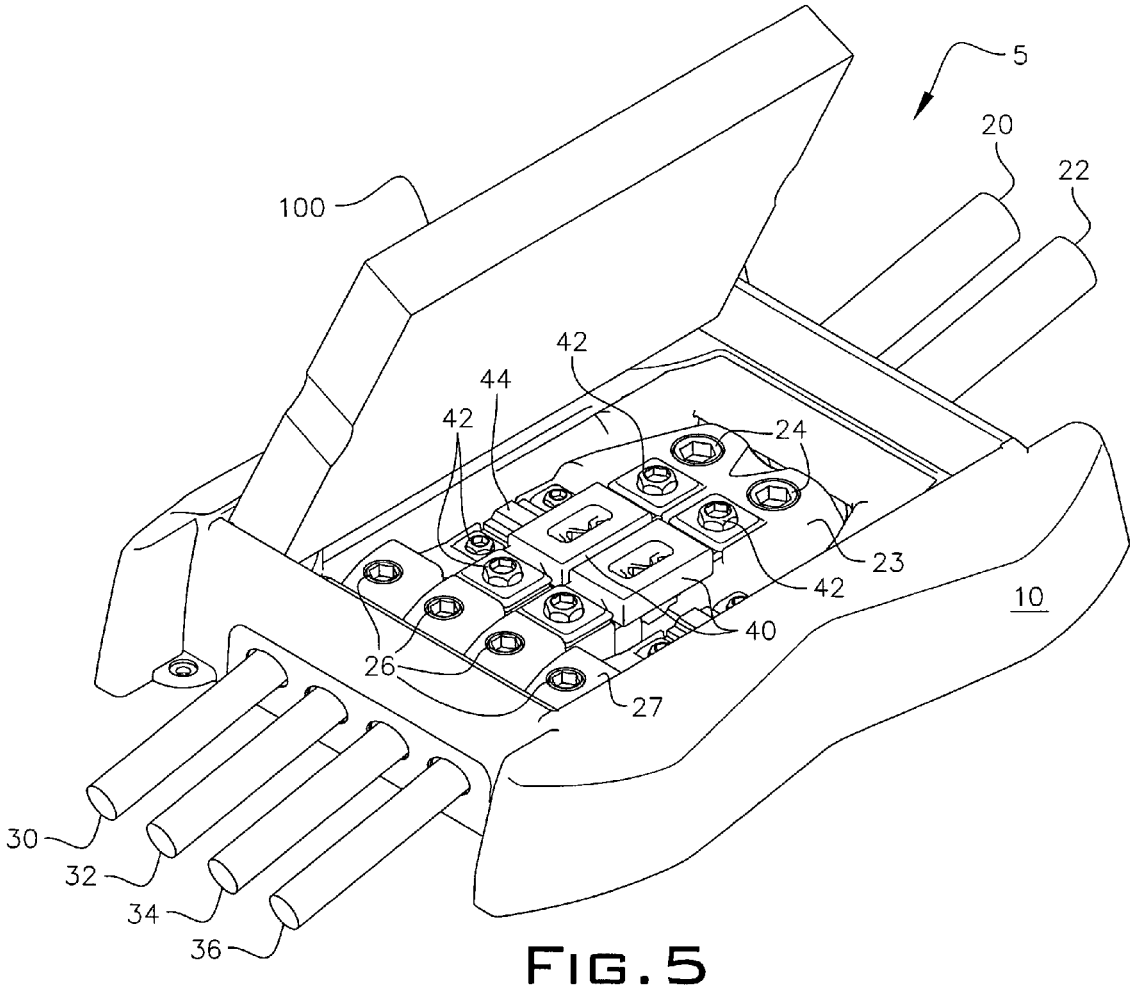
FIG. 5 illustrates a perspective view of the apparatus of the present invention configured for opposite connections to that of FIG. 1.

Referring to FIG. 5, a perspective view of the apparatus of the present invention configured for opposite connections to that of FIG. 1 is shown. The power distribution system 5 includes an outer case 10 with a display (not visible) housed within a display housing 100. The power distribution system 5 has a rotatable and exchangeable power distribution device configurable with various power options that can be oriented so that power enters on the left side and exits on the right side or visa-versa, providing flexibility in the direction of the display. The power distribution system 5 in this embodiment has four power outputs 30/32/34/36 connected through a power output connector, in this embodiment a terminal block 27. The power output wires 30/32/34/36 are physically and electrically held by set screws 26. The outputs 30/32/34/36 are connected to a first terminal 42 of the fuses 40/44. In this embodiment, two types of fuses are installed 40/44 but in some embodiments, only one type of fuse 40 or the other 44 is installed providing flexibility in protection for each output 30/32/34/36. The second terminal 42 of the fuses 40/44 is connected to a power input connector, in this embodiment a terminal block 23 for connection to the input power wires 20/22. The input power wires 20/22 are electrically and physically coupled with set screws 24.

Figure 6:
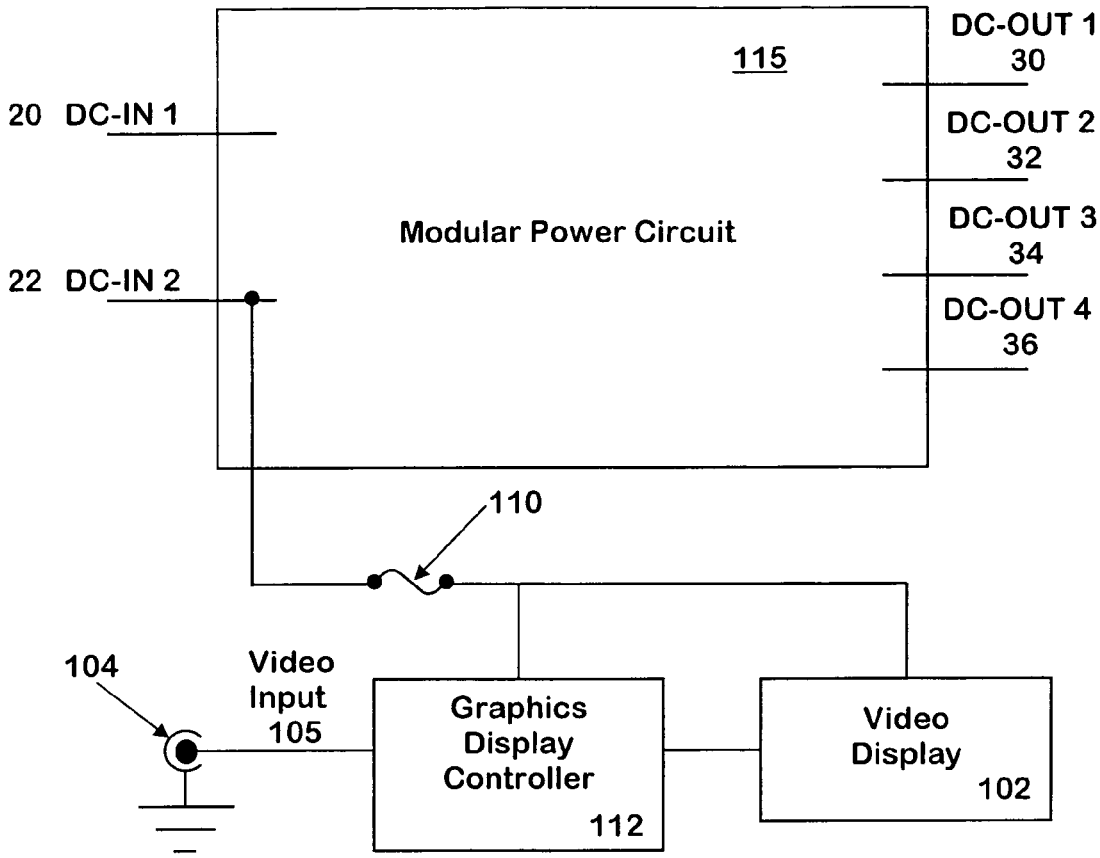
FIG. 6 illustrates a schematic diagram of the common electronics of the present invention.

Referring to FIG. 6, a schematic diagram of the common electronics of the present invention is shown. In this embodiment, two DC inputs 20/22 enter the power distribution device or modular power circuit 115. In other embodiments, one, three, four or any number of DC inputs is present. The content and function of the power distribution device 115 will be described in the description of FIGS. 7–10. Generally, the power distribution device 115 is a device that accepts power from a power source and distributes the power to one or more power outputs. In some embodiments, the power distribution device 115 provides protection by way of fuses or surge suppressors or provides power conditioning.

Also in this embodiment, four DC outputs 30/32/34/36 exit the power distribution device 115. In other embodiments, one, two, three or any number of outputs exits the power distribution device 115. A connection to one of the DC inputs 22 is made to derive power for the internal electronics, indicators and displays. In some embodiments, the power passes through a fuse 110 to protect from an overload in the internal electronics and display. In the present embodiment, the input video signal 105 from the video input connector 104 is routed to a graphics display controller 112 which accepts a video signal from the video connector 104 such as NTSC, RGB, S-video, composite video, SECAM, PAL and the like, decodes the signal and generated signals required by the video display 102, for example, LVDS (Low Voltage Differential Signal) and parallel. The display is preferably a liquid crystal display (LCD), but can be any flat panel display including Plasma.

In some embodiments, the graphics display controller 112 generates colors and patterns on the video display 102 independently of the video input 105. In these embodiments, there is a user interface (not shown) consisting of an input device such as a keyboard or keyboard and mouse (not shown), configured to accept commands from a user to set up the display colors, patterns and sequences.

Figure 7:
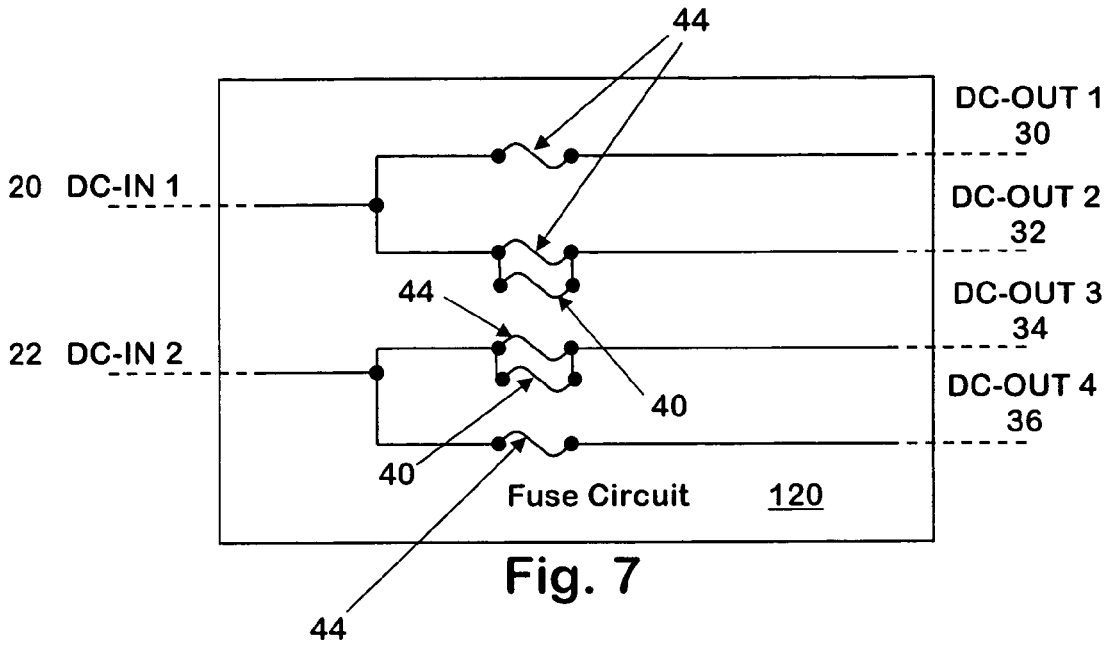
FIG. 7 illustrates a schematic diagram of a fused distribution option of the present invention.

Referring to FIG. 7, a schematic diagram of a fused distribution option 120 of the present invention is shown. The circuit shown includes two DC inputs 20/22 connected to four DC outputs 30/32/34/36 by fuses 40/44. Note that in some embodiments more than one type of fuse receptacle is deployed in parallel providing flexibility in fuse selection and current handling. By installing more than one type of fuse in parallel, the current handling capacity is increased.

Figure 8:
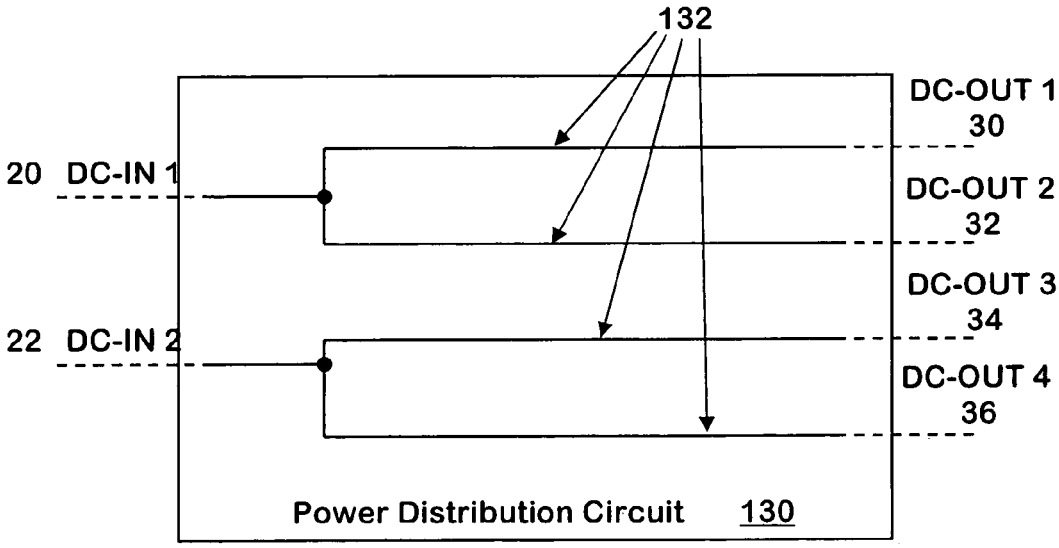
FIG. 8 illustrates a schematic diagram of a distribution block option of the present invention.

Referring to FIG. 8, a schematic diagram of a distribution block option 130 of the present invention is shown. The circuit includes two DC inputs 20/22 directly connected to four DC outputs 30/32/34/36 through wiring paths 132.

Figure 9:
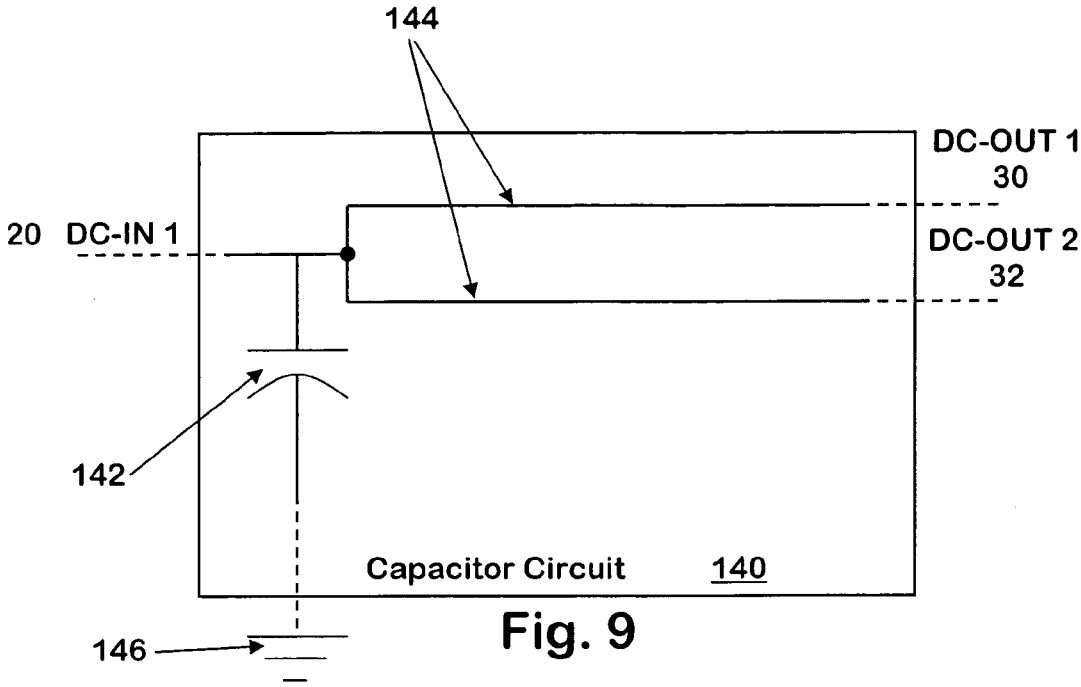
FIG. 9 illustrates a schematic diagram of a high capacity capacitor option of the present invention.

Referring to FIG. 9, a schematic diagram of a high capacity capacitor option 140 of the present invention is shown. The circuit includes a DC input 20 directly connected to two DC outputs 30/32 with a capacitor 142 between the DC input 20 and ground 146. The capacitor 142 is, for example, a high-capacity electrolytic or super capacitor. The value of the capacitor is, for example, 10–30 farads at 15 volts.

Figure 10:
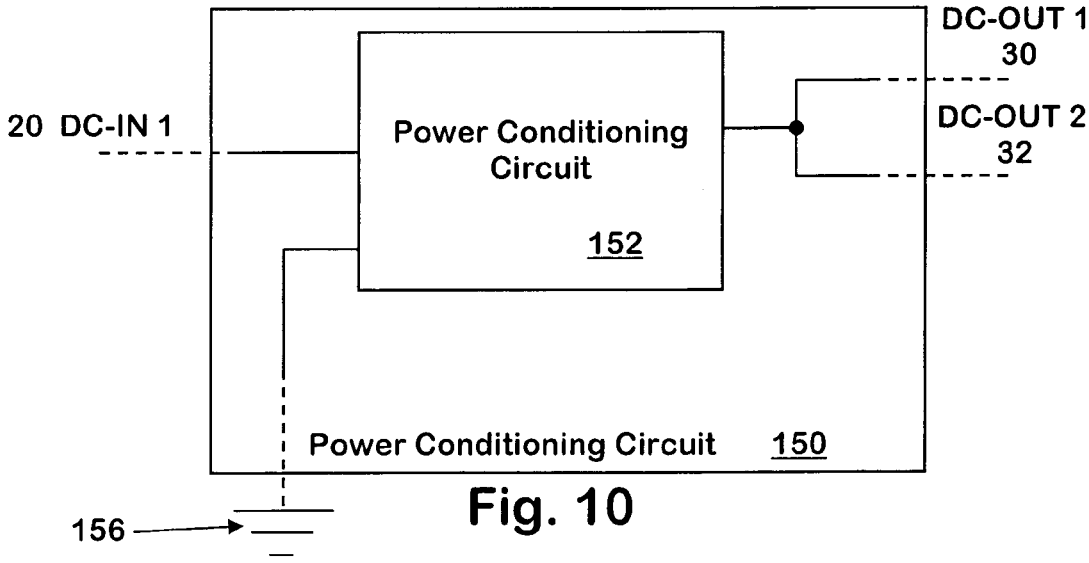
FIG. 10 illustrates a schematic diagram of a power conditioning circuit option of the present invention.

Referring to FIG. 10 illustrates a schematic diagram of a power conditioning circuit option 150 of the present invention. The circuit includes a DC input 20 that is conditioned with a power conditioning circuit 152 before passing to two DC outputs 30/32. The power conditioning circuit 152 is also connected to a ground 156. In some embodiments, the power conditioning circuit 152 includes circuitry to regenerate the standard 12V output by switching the DC input voltage at a high frequency into a transformer (e.g., a torroid transformer), then regulating and filtering the output of the transformer to conform to the required 12V output, thereby eliminating any voltage fluctuations and noise created by the vehicle's engine or high current devices such as starter motors, lights, power seats and the like.

Figure 11A:
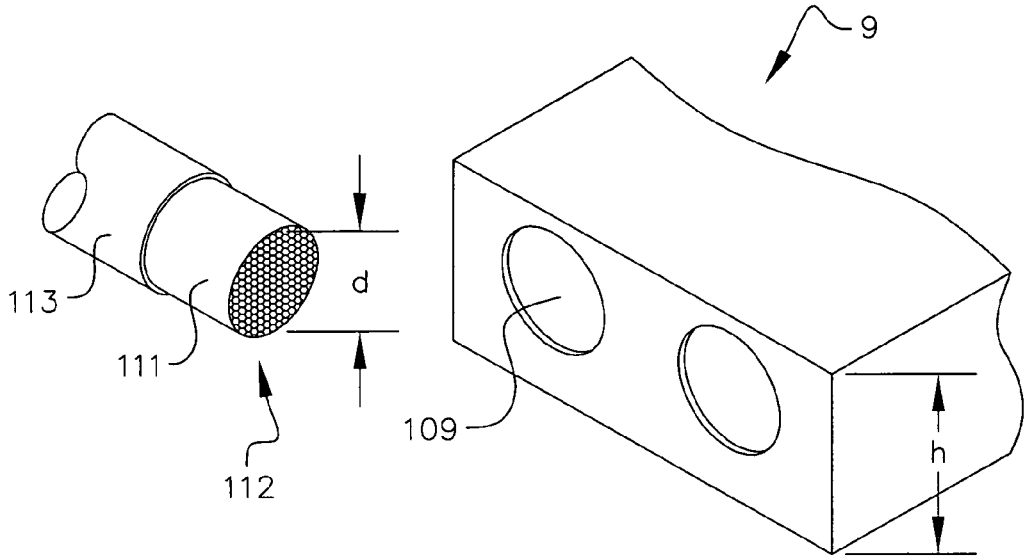
FIG. 11A (PRIOR ART)
FIG. 11*a* illustrates a power cable and a power distribution box of the prior art.

Referring to FIG. 11*a*, a wire or power cable and power distribution system of the prior art is shown. The power cable 112 is substantially round or tubular and has a central conductor 111 and an insulator 113. The power distribution system 9 of the prior art has a round receptacle 109 for accepting the power cable 112. The height, h, of the power distribution system 109 must be greater than the diameter, d, of the power cable 112.

Figure 11B:
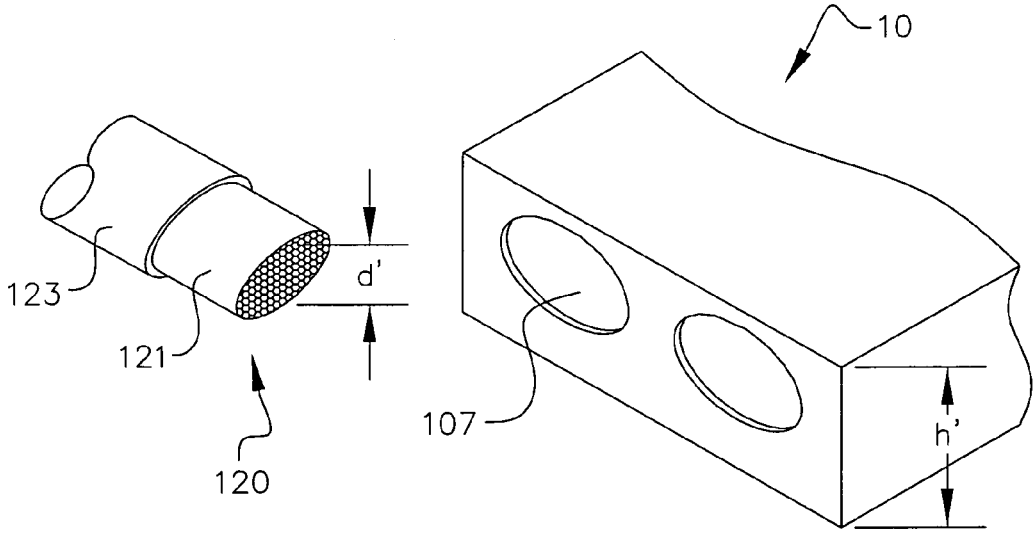
FIG. 11*b* illustrates a power cable and a power distribution box of the present invention.

Referring to FIG. 11*b*, a wire or power cable and power distribution system of the present invention is shown. The power cable 120 is substantially oval or elliptical and has a central conductor 121 that is also substantially oval or elliptical and an insulator 123 that is also substantially oval or elliptical. The power distribution system 10 of the present invention has an oval or elliptical receptacle 107 for accepting the power cable 120. The height, h' of the power distribution system 10 is greater than the diameter, d', of the power cable 120, but since the diameter d' of the elliptical cable 120 is smaller than the diameter d of the round cable 112, it is possible for the height h' of the power distribution system of the present invention to be less than the height h of the power distribution system of the prior art, providing a much lower profile power distribution system that looks better and fits better in tight compartments.

Figure 12:
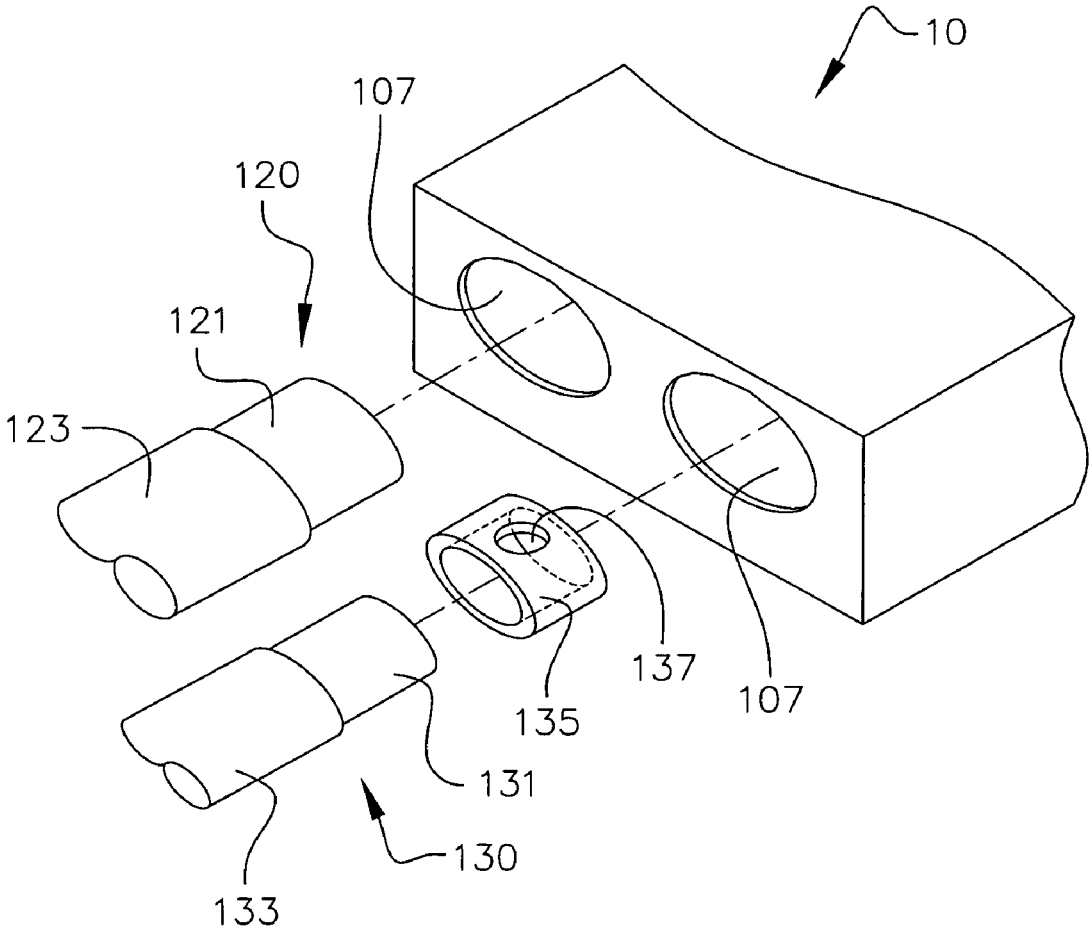
FIG. 12 illustrates a cable size adapter of the present invention.

Referring now to FIG. 12, a cable size adapter of the present invention is shown. The power distribution system 10 has openings and terminal blocks 107 that are sized to accept one size of wire 120. The insulation 123 of the wire 120 is stripped, exposing the oval conductor 121 which is then inserted into the power distribution terminal block 10 into the oval opening 107 where it is held in place by a set screw (shown in FIGS. 1, 4 and 5). The size of the opening 107 and terminal block are adapted to one specific size of wire. If a smaller wire 130 is used without an adapter 135, the set screw would not properly hold the wire in place and proper conduction would not be achieved. Instead, the smaller wire 130 has its insulation 133 stripped exposing its smaller oval conductor 131 and the exposed oval conductor 131 is inserted into a cable size adapter 135 and the smaller wire 130 and cable size adapter 135 are then inserted into the opening 107 and fastened with a set screw. In some embodiments, the cable size adapter 135 has a hole 137 sized to allow the set screw to pass through the cable size adapter 135 and apply pressure directly to the conductor 131. The adapter 135 is made from a conductive material, preferably copper or brass. In some embodiments, the adapter 135 is plated with another conductive metal such as nickel, brass, gold or silver.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A power distribution system with configurable input-output connections, the power system comprising:

an enclosure; and a configurable power distribution device removably housed within the enclosure, the configurable power distribution device adapted to accept power from at least one power input connector and the configurable power distribution device adapted to deliver the power to at least one power output connector, a graphics display hingedly mounted to the enclosure wherein the graphics display is controlled by a graphics display controller;

wherein the at least one power input connector is situated on a first side surface of the configurable power distribution device, and the at least one power output connector is situated on a second side surface of the configurable power distribution device, the second side surface of the configurable power distribution device directly opposing the first side surface of the configurable power distribution device, and whereas the configurable power distribution device is configurable such that the first side surface of the configurable power distribution device is aligned with one of a first side surface of the enclosure and a second side surface of the enclosure.

2. The power system of claim 1, wherein the configurable power distribution device passes the power from the at least one power input connector through at least one fuse to the at least one power output connector.

3. The power system of claim 1, wherein the configurable power distribution device passes the power from the at least one power input connector to the at least one power output connector and at least one capacitor is coupled between the at least one power input connector and a ground potential.

4. The power system of claim 1, wherein the configurable power distribution device passes the power from the at least one power input connector through a power conditioning circuit to the at least one power output connector.

5. The power system of claim 1, wherein the graphics display controller is connected to a video input connector mounted on the periphery of the enclosure.

6. The power system of claim 1, wherein the the graphics display controller generates colors and patterns for display on the graphics display.

7. The power system with display of claim 1, wherein the power distribution device is adapted to be installed in a first configuration and in a second configuration, in the first configuration the at least one power input connector situated on the first side surface of the enclosure and in the second configuration the at least one power input connector situated on the second side surface of the enclosure.

8. A method for distributing power comprising:

providing a power system, the power system:

an enclosure; and a configurable power distribution device removably housed within the enclosure, the configurable power distribution device adapted to accept power from at least one power input connector and the configurable power distribution device adapted to deliver the power to at least one power output connector, a graphics display hingedly mounted to the enclosure, the graphics display controlled by a graphics display controller;

wherein the at least one power input connector situated on a first side surface of the configurable power distribution device, the at least one power output connector is situated on a second side surface of the configurable power distribution device, the second side surface of the configurable power distribution device directly opposes the first side surface of the configurable power distribution device, and whereas the configurable power distribution device is configurable such that the first side surface of the configurable power distribution device is aligned with a sides surface of the enclosure, installing the power distribution device into the enclosure such that the at least one power input connector is positioned towards at least one power input wire and the at least one power output connector is positioned towards at least one power output wire;

inserting the at least one power output wire to the at least one power output connector and tightening a set screw associated with each of the at least one power output connectors; and connecting the at least one power input wire to the at least one power input connector and tightening another set screw associated with each of the at least one power input connectors.

9. The method claim 8, wherein the power distribution device passes the power from the at least one power input connector through at least one fuse to the at least one power output connector.

10. The method claim 8, wherein the power distribution device passes the power from the at least one power input connector to the at least one power output connector and at least one capacitor is coupled between the at least one power input connector and a ground potential.

11. The method claim 8, wherein the power distribution device passes the power from the at least one power input connector through a power conditioning circuit to the at least one power output connector.

12. The method claim 8, wherein the graphics display controller is connected to a video input connector mounted on the periphery of the enclosure.

13. The method claim 8, wherein the graphics display controller generates colors and patterns for display on the graphics display.

14. The method claim 8, wherein the power distribution device is adapted to be installed in a first configuration and in a second configuration, in the first configuration the at least one power input connector appearing on a first side of the enclosure and in the second configuration the at least one power input connector appearing on an opposite side of the enclosure.

15. An power distribution system comprising:

an enclosure means;

a means to display graphic images mounted within a display enclosure, the display enclosure hingedly coupled to the enclosure means; and a means to distribute power housed within the enclosure means, the means to distribute power adapted to accept power from a means to input power and the means to distribute power adapted to deliver the power to a means to output power, the means to input power situated on a side edge of the means to distribute power and the means to output power situated on an opposite side edge of the means to distribute power, the enclosure means adapted to permit the installation of the means to distribute power in a first configuration having the means to input power on a left side of the enclosure means and to permit the installation of the means to distribute power in a second configurations having the means to input power on a right side of the enclosure means.

16. The power system with display of claim 15, wherein the means to distribute power passes the power from the means to input power through at least one fuse means to the means to output power.

17. The power system with display of claim 15, wherein the means to distribute power passes the power from the means to input power to the means to output power and at least one capacitor is coupled between the means to input power and a ground potential.

18. The power system with display of claim 15, wherein the means to distribute power passes the power from the means to input power through a power conditioning circuit to the means to output power.

19. The power system with display of claim 15, wherein the means to display graphic images is controlled by a graphics display controller means and the graphics display controller means is connected to a video input means mounted on the periphery of the enclosure.

20. The power system with display of claim 15, wherein the means to display graphic images is controlled by a graphics display controller means and the graphics display controller means generates colors and patterns for display on the means to display graphic images.

* * * * *